United States Patent [19]

Gunzel, Jr. et al.

[11] Patent Number: 5,039,016

[45] Date of Patent: Aug. 13, 1991

[54] ASPIRATION-TYPE CHEMICAL SPRAYER

[75] Inventors: Rudolph M. Gunzel, Jr., Palm Springs; Ronald F. Englhard, Mission Viejo; Donald J. Shanklin, Fullerton, all of Calif.

[73] Assignee: Hayes Products, Santa Fe Springs, Calif.

[21] Appl. No.: 468,845

[22] Filed: Jan. 23, 1990

[51] Int. Cl.[5] ..... B05B 7/30

[52] U.S. Cl. ..... 239/314; 239/318; 222/484; 222/554

[58] Field of Search ..... 239/310, 311, 314, 318; 222/482, 483, 484, 554

[56] References Cited

U.S. PATENT DOCUMENTS 2,837,374 6/1958 Lipman ..... 222/484

3,186,643 1/1965 George et al. ..... 239/318

4,750,764 6/1988 Chow et al. ..... 239/318

*Primary Examiner*—Andres Kashnikow

*Assistant Examiner*—Karen B. Merritt

*Attorney, Agent, or Firm*—Jackson & Jones

[57] ABSTRACT

An improved aspiration-type chemical sprayer for dispensing small quantities of a liquid-based chemical into a stream of carrier fluid is disclosed. The sprayer includes a sprayer head assembly sealingly mounted onto a container for storing the chemical to be dispensed. The sprayer head assembly includes a multi-function unitary valve for providing a range of aspiration rates simultaneously with full communication of the container interior to atmospheric pressure. The valve may include means for positive and simultaneous closure of the aspiration and vent passages so as to seal the chemical in the container when the sprayer is not in use.

16 Claims, 3 Drawing Sheets

10
12
14
38
40
46
48
50
52
54
5
6
7
8
28
42
44
51
62
88
90

10
14
16
18
20
21
22
22a
22b
24
25
26
27
28
30
32
34
36
38
40
42
44
46
48
52
54
56
62
63
64
66
74
84
86

10
14
16
22b
28
34
36
38
40
42
44
46
48
50
51
52
54
56
58
60
62
64
66
68
70
72
74
76
78
82
84
86
88

ASPIRATION-TYPE CHEMICAL SPRAYER

BACKGROUND OF THE INVENTION

The present invention is directed to aspiration-type sprayers for use in dispensing small quantities of a liquid- based chemical into a relatively large quantity of a carrier fluid. The device is particularly suited for lawn and garden and agricultural applications where chemicals, such as pesticides and fertilizers are applied to crops, plants, lawns and other vegetation. Because of the usually hazardous nature of the chemicals to be applied, it is desirable to market such products in containers which are permanently sealed to a sprayer head so as to minimize inadvertent human exposure, such as from careless handling or unauthorized access by children, to a concentrated chemical. To make such nonrefillable products economically feasible it is necessary to provide a sprayer which is of sufficiently low cost to allow the entire unit to be discarded when the container contents have been exhausted. It is therefore desirable to provide a sprayer which is inexpensive to manufacture and yet will reliably and safely provide a wide range of mixing ratios to meet the particular requirements of the individual user.

Prior art sprayers, such as that shown in Chow et al. U.S. Pat. No. 4,750,674, the disclosure of which is hereby incorporated by reference, teaches a sprayer assembly having a system of air vent and aspiration openings of different sizes to obtain a selection of discrete mixing ratios. The mechanism requires a system of cups to block openings associated with nonselected aspiration rates and to provide the desired fluid communication. Such a system, however, requires the alignment and assembly of a plurality of elements including openings, cup seals and springs. Such a system complicates manufacture and assembly thereby failing to fully minimize cost. Further, such devices fail to provide a simplified sprayer with a minimum of complex moving parts and a continuous range of mixing ratios. Employing the teaching of Chow et al., a range of mixing ratios would require a prohibitively complicated system of moving cup seals for alignment with a large number of alternative sized aspiration openings.

Other prior art sprayers, such as that shown in George et al. U.S. Pat. No. 3,186,643, the disclosure of which is hereby incorporated by reference, use a rotating carrier fluid valve having a range of adjustability of carrier fluid flow in combination with a vent bore closure boss extending from the rotating valve. Such control of carrier fluid flow fails to provide means for varying the desired rate of chemical dispensing while maintaining a selected distance and strength of spray projection.

Therefore a need exists for an aspiration-type chemical sprayer having simplified design and ease of manufacture which provides a range of direct control of the aspiration passageway while providing for leak resistant operation and secure and simultaneous closure of both the aspiration and vent passageways for positive chemical flow shut-off when the sprayer is not in use.

SUMMARY OF THE INVENTION

The present invention is directed to a simplified and inexpensive aspiration-type chemical sprayer which can be operated over a range of aspiration rates independently of the rate of carrier fluid flow. The invention further enhances sprayer control by providing for direct and simultaneous closure of the aspiration and vent passageways so as to seal the potentially hazardous chemicals stored in the container interior when not is use.

The invention accomplishes these objectives in part by employing a simplified aspiration valve of inexpensive design. The valve performs multiple control functions by providing means integrally formed thereto for vent and aspiration passageway closure. Such means simultaneously register with the respective vent and aspiration passageway opening at a designated valve position relative to the spray head housing, providing means for full or partial communication of the aspiration passageway for control of chemical flow to the carrier fluid, and providing vent channeling means for complete communication of atmospheric pressure to the container interior simultaneously with any valve position associated with an open or partially open aspiration passageway.

The need to provide an inexpensive chemical sprayer is further satisfied by employing a single valve, independent of carrier fluid control, of unitary construction, thereby simplifying sprayer head assembly. Such construction further enhances the economic viability of the product by providing a positive seal between the spray head and container thereby rendering the sprayer safer, particularly for household applications where a throw away product following full dispensing of the stored chemical is preferred.

The foregoing and other objectives, features and advantages of the present invention will be more readily understood upon consideration of the following detailed description of the invention taken in conjunction with the accompanying drawings.

DESCRIPTION OF THE PREFERRED EMBODIMENT

Figures 1, 2, 3, 4:
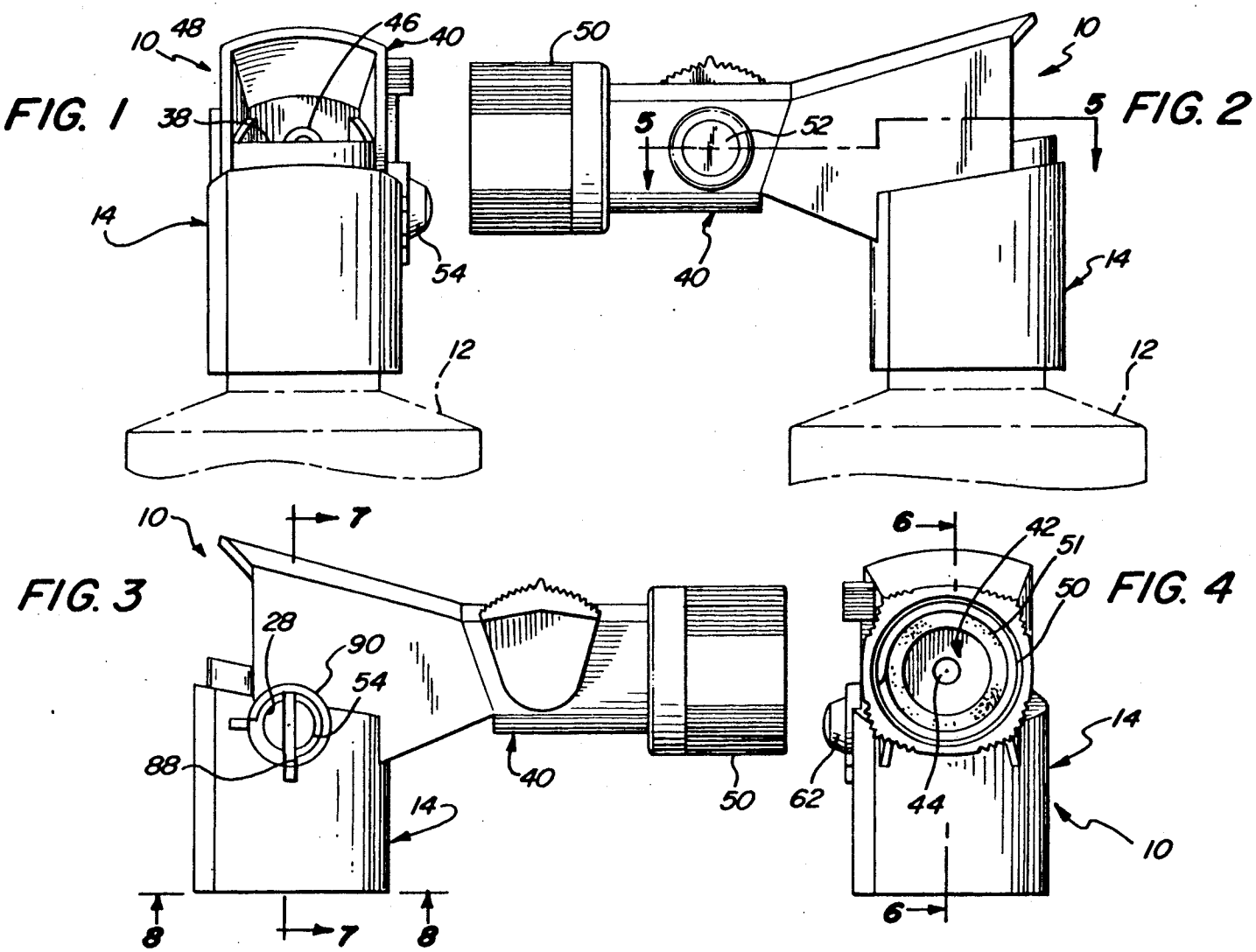
FIG. 1 is a front elevational view of an exemplary embodiment of the sprayer head assembly of the present invention installed on a container.
FIG. 2 is a side elevational view of the sprayer head assembly of FIG. 1.
FIG. 3 is an elevational view of the opposite side of the sprayer head assembly of FIG. 2.
FIG. 4 is a rear elevational view of the sprayer head assembly of FIG. 3.
Figures 5, 7, 8:
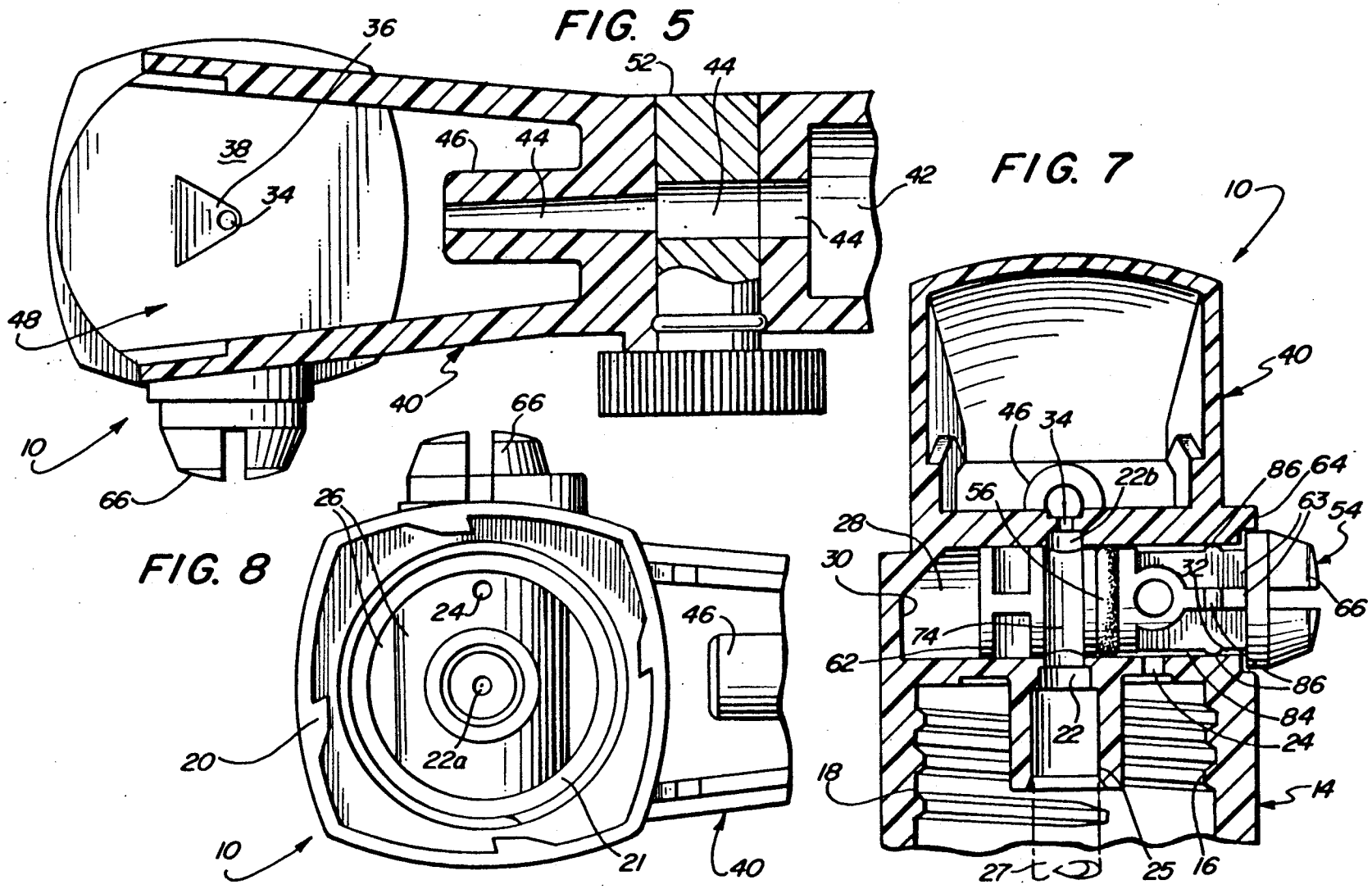
FIG. 5 is a sectional view taken along line 5—5 of FIG. 2.
FIG. 7 is a sectional view taken along line 7—7 of FIG. 3.
FIG. 8 is a sectional view taken along line 8—8 of FIG. 3.
Figures 6, 9, 10:
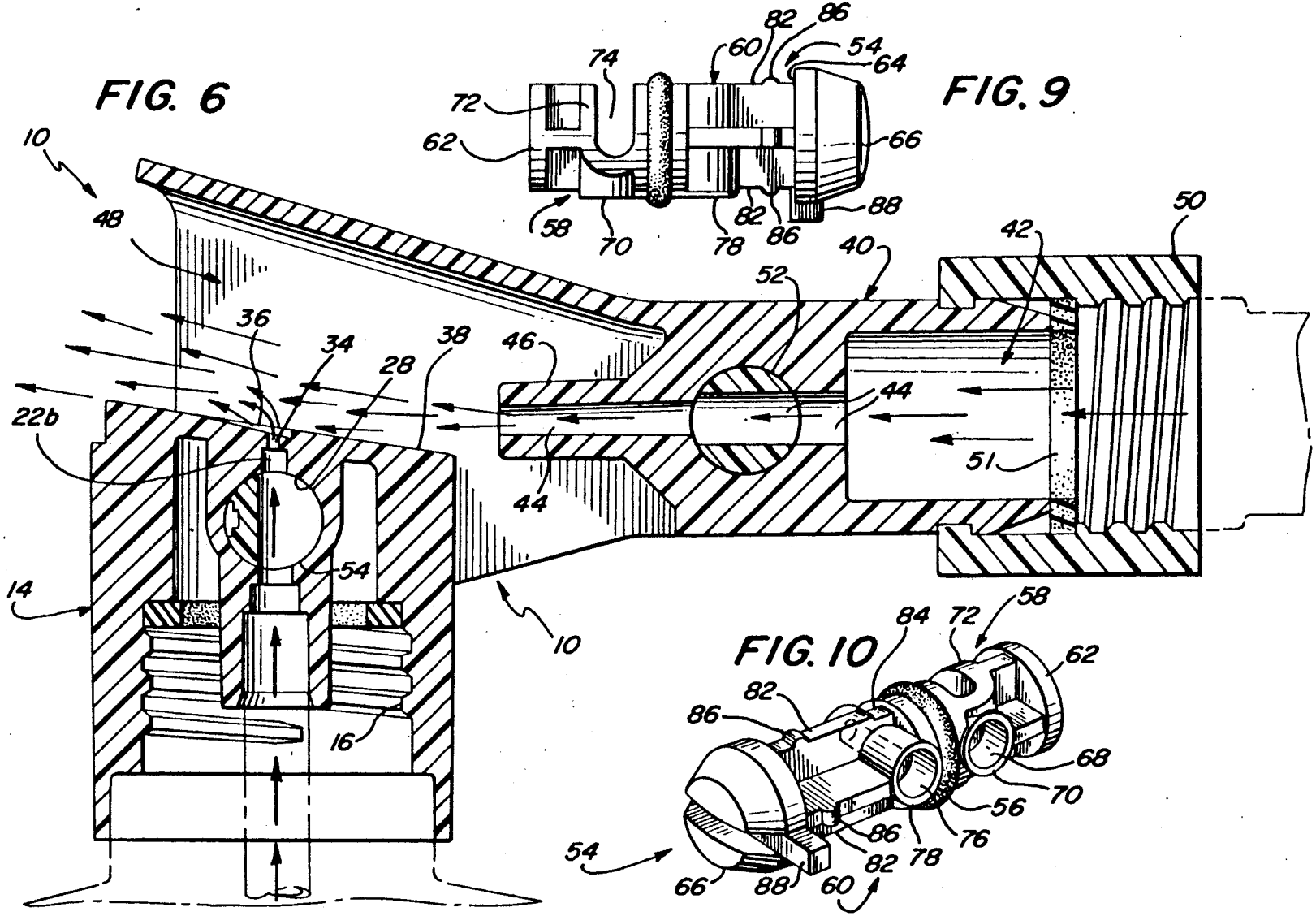
FIG. 6 is a sectional view taken along line 6—6 of FIG. 4.
FIG. 9 is a side elevational view of an exemplary embodiment of the aspiration control valve of the present invention.
FIG. 10 is a front perspective view of the valve of FIG. 9.

Referring to the drawings, a preferred embodiment of the present invention is shown in FIGS. 1, 2, and 6 as comprising a sprayer head assembly 10 sealably and nonremovably secured to the mouth of a chemical container 12. As best seen in FIGS. 6 and 8, the desired connection can be achieved by providing the depending sprayer neck 14 with internal threads 16 which receive the cooperating threads 18 surrounding the mouth of container 12. As best seen in FIG. 8, the sprayer neck includes inwardly directed lugs 20 which oppose cooperating lugs, not shown, formed on the container 12, thereby preventing removal of the sprayer head assembly following installation onto a chemically filled container 12. The interior cavity of neck 14 for receiving the mouth of container 12 employs a washer 21 to provide a sealing engagement with the container. When installed to the sprayer head assembly 10, the mouth of container 12 is in communication with upstream aspiration duct 22*a*, vent port 24 and the otherwise closed upper interior 26 of neck 14. The opening 22*a* communicates with a downwardly depending sleeve 25 from which a dip tube 27 extends downward terminating proximate the bottom of container 12. Duct 22*a* and port 24 also communicate with the interior of cylindrical bore 28 formed in neck 14, as best seen in FIG. 7. The bore 28 includes a closed end 30 and an open end 32. A downstream aspiration duct 22*b* also communicates with bore 28 opposite duct 22*a*. As best seen in FIGS. 6 and 7, the duct 22*b* communicates with aspiration orifice 34 positioned in a graduated recess 36 formed on an upper inclined wall 38 of neck 14.

The sprayer includes a nozzle portion 40 which forms an input chamber 42, constricted carrier fluid passageway 44, tubular nozzle shaft 46 and expansion chamber 48. The nozzle portion 40 forms a unitary structure with neck 14 and is formed thereto so as to project a flow of carrier fluid into expansion chamber 48 from tubular nozzle shaft 46, the flow being directed across upwardly inclined wall 38 proximate recess 36. The upstream end of nozzle portion 40 includes a conventional rotatable coupler 50, including a washer 51, for threaded sealing engagement between input chamber 42 and a source of pressurized carrier fluid, for example, a garden hose. The carrier fluid is received in input chamber 42 and controlled through constricted passageway 44 by means of a rotatable carrier fluid control valve 52 to nozzle shaft 46 for discharge into expansion chamber 48.

Communication of vent port 24 with atmospheric pressure and communication of aspiration orifice 34 with the contents of container 12 are controlled by rotatable valve 54 shown in FIGS. 7, 9 and 10. Valve 54 is constructed to define a cylindrical periphery for sliding engagement with the cylindrical interior wall of bore 28. The valve outer periphery is divided by O-ring 56 which rests in a circumferential groove, not shown. The O-ring divides the valve into an aspiration control segment 58 and a vent control segment 60. The valve 54 is inserted into bore 28 so as to position the valve end 62 adjacent the closed end 30. The valve length is so selected and oriented that when the steps 63 formed on shoulder 64 of valve head 66 rest on neck 14 proximate the outer periphery of open end 32, the valve is functionally aligned relative to the openings 22*a*, 22*b* and 24. The O-ring 56 engages the cylindrical wall of bore 28 so as to sealingly partition the aspiration control segment 58 within the bore 28 adjacent the closed end 30. The segment 58 forms a cell 68 recessed within an aspiration collar 70, which collar defines a portion of the outer cylindrical periphery of the valve 56 so as to sealingly engage the cylindrical wall of bore 28. When the cell 68 is in registry with the opening of upstream aspiration duct 22*a*, communication of the contents of container 12 with aspiration orifice 34 is prevented. The segment 58 further defines a jaw periphery 72 and a U-channel 74. When the U-channel 74 is in full or partial registry with both openings 22*a*, 22*b*, communication of the contents of container 12 is possible at a rate of flow proportional to the extent of such registry. The jaw periphery 72 defines a portion of the outer cylindrical periphery of the valve 54 so as to sealingly engaged the cylindrical wall of bore 28.

The segment 60 forms a cell 76 recessed within a vent collar 78, which collar defines a portion of the outer cylindrical periphery of the valve 52 so as to sealingly engage the cylindrical wall of bore 28. When the cell 76 is in registry with the opening of vent port 24, communication of atmospheric pressure with the interior of container 12 is prevented by the engagement of collar 78 with the cylindrical wall of bore 28.

The cells 68, 76 are formed on valve 54 so as to provide for their simultaneous registry with opening 22*a* and port 24, respectively, at a designated position of rotation of the valve 52, thereby sealing the contents of container 12 therein. The segment 60 is configured to provide full communication of port 24 to atmospheric pressure through the open end 32 of bore 28 simultaneously with full or partial registry of both openings 22*a*, 22*b* with U-channel 74. This is achieved by providing the valve head shoulder 64 with a plurality of steps 63 so as to provide gaps between the valve head shoulder 64 and the surface of neck 14 proximate bore open end 32. The vent port 24 communicates with the bore open end 32 by channels formed between adjacent arms 82. As shown in FIG. 7, in the valve position of full registry of openings 22*a*, 22*b*, the valve arm adjacent port 24 is provided with a slot 84 to prevent restriction of port 24 by the arm outer periphery. Each arm 82 is formed to provide a protruding peripheral bead 86 adjacent the head 66 which reduces frictional contact between the outer periphery of each arm and the cylindrical wall of the bore 28, thereby lessening the resistance of the valve to rotational movement. The valve is designed to provide a 90 degree range of rotation between the fully open and closed positions. The valve head includes a tab 88 which restricts valve rotation to such a range between the ends of a raised arcuate collar 90 formed on the surface of neck 14.

In operation, when the valve 52 is opened, a stream of pressurized fluid is discharged through the nozzle shaft 46 into expansion chamber 48 resulting in a zone of reduced pressure outside the aspiration orifice 34. As best seen in FIG. 6, if the valve 54 is fully or partially opened, the suction created by the low pressure in expansion chamber 48 draws the chemical solution in the container through tube 27, sleeve 25, duct 22*a*, U-channel 74, duct 22*b*, orifice 34 and into the stream of carrier fluid. Rotation of valve 54 results in varying registry of ducts 22*a*, 22*b* with U-channel 74 thereby providing direct control of the rate of flow of the chemical solution into the flow of carrier fluid so as to obtain the desired concentration of chemical in the carrier fluid projected from the sprayer. When valve 52 is fully or partially opened and the valve 54 is set at the closed position designated for simultaneous alignment of cells 68, with duct 22*a* and port 24, respectively, the container is effectively sealed and the sprayer serves to dispense only carrier fluid.

The terms and expressions which have been employed in the foregoing specification are used herein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An aspiration-type chemical sprayer comprising:

a container having an interior for storing a chemical to be sprayed;

a spray head assembly defining an expansion chamber and having inlet means for directing a pressurized flow of carrier liquid into said expansion chamber;

connection means for sealably mounting said spray head assembly to said container;

said spray head assembly further defining an aspiration passageway for communication between said container interior and said expansion chamber, and a vent passageway for communication of atmospheric pressure with said container interior;

a valve rotatably positioned within said spray head assembly so as to simultaneously intersect said aspiration passageway and said vent passageway;

said valve having integrally formed thereto aspiration closure means, vent closure means, aspiration channeling means and vent channeling means, for controlling communication through said aspiration and vent passageways; and said valve being formed so as to provide simultaneous registry of said aspiration and vent passageways with said aspiration and vent closure means at one rotational position of said valve and to provide simultaneous registry of said aspiration and vent passageways with said aspiration channeling and vent channeling means at another rotational position of said valve.

2. The apparatus of claim 1 wherein said aspiration channeling means has, within a designated range of rotational movement of said valve, a range of registry with said aspiration passageway simultaneously with full registry of said vent channeling means with said vent passageway.

3. The apparatus of claim 1 wherein said spray head assembly includes means independent of said valve for controlling the flow of carrier fluid to said inlet means.

4. The apparatus of claim 1 wherein said spray head assembly includes an interior surface defining a bore for receiving and engaging said valve.

5. The apparatus of claim 4 wherein said valve is rotatably positioned within said bore.

6. The apparatus of claim 5 wherein said aspiration and vent closure means each include a respective closed cell defined in said valve for engagement with a respective passageway.

7. The apparatus of claim 6 wherein said closed cells each include a surrounding collar for a sealing engagement with a respective passageway.

8. The apparatus of claim 5 wherein said aspiration channeling means includes a jaw defining a U-shaped channel.

9. The apparatus of claim 5 wherein said bore includes an open end and a closed end.

10. The apparatus of claim 9 wherein said valve is received in said bore so as to position said aspiration closure means and said aspiration channeling means proximate said closed end and to position said vent closure means and said vent channeling means proximate said open end.

11. The apparatus of claim 10 wherein said vent channeling means includes a valve head having a plurality of steps on an inner shoulder.

12 The apparatus of claim 11 wherein said vent channeling means includes one or more channels formed between said valve and said interior surface defining said bore.

13. The apparatus of claim 12 wherein said vent channeling means further includes one or more slots formed on said valve for communication between said channels proximate said vent passageway.

14. The apparatus of claim 5 wherein said valve includes an O-ring positioned to sealingly partition said aspiration closure means and said aspiration channeling means from said vent closure means and said vent channeling means when said valve is installed in said bore.

15. An aspiration-type chemical sprayer comprising:

a container having an interior for storing a chemical to be sprayed;

a spray head assembly defining an expansion chamber and having inlet means for directing a pressurized flow of carrier fluid into said expansion chamber;

connection means for sealably mounting said spray head assembly to said container;

said spray head assembly further defining an aspiration passageway for communication between said container interior and said expansion chamber, and a vent passageway for communication of atmospheric pressure with said container interior;

a valve movably positioned within said spray head assembly so as to simultaneously intersect said aspiration passageway and said vent passageway;

said valve having integrally formed thereto aspiration closure means, vent closure means, aspiration channeling means and vent channeling means, for controlling communication through said aspiration and vent passageways; and said valve being formed so as to provide simultaneous registry of said aspiration and vent passageways with said aspiration and vent closure means at a designated position of said valve, said aspiration channeling means has, within a designated range of movement of said valve, a range of registry with said aspiration passageway simultaneously with full registry of said vent channeling means with said vent passageway.

16. The apparatus of claim 15 wherein said aspiration and vent closure means each include a respective closed cell defined in said valve for engagement with a respective passageway.

* * * * *

UNITED STATES PATENT AND TRADEMARK OFFICE

CERTIFICATE OF CORRECTION

PATENT NO. : 5,039,016

DATED : August 13, 1991

INVENTOR(S) : Gunzel, Jr. et al.

It is certified that error appears in the above-identified patent and that said Letters Patent is hereby corrected as shown below:

Column 3, line 64, "56" should read --54--.

Column 4, line 62, after "68," should be --76--.

Signed and Sealed this

Twenty-ninth Day of December, 1992

*Attest:*

DOUGLAS B. COMER

*Attesting Officer*

*Acting Commissioner of Patents and Trademarks*

US005039016C1

(12) REEXAMINATION CERTIFICATE (4288th)

United States Patent

Gunzel, Jr. et al.

(10) Number: US 5,039,016 C1

(45) Certificate Issued: Mar. 13, 2001

(54) ASPIRATION-TYPE CHEMICAL SPRAYER

(75) Inventors: Rudolph M. Gunzel, Jr., Palm Springs; Ronald F. Englhard, Mission Viejo; Donald J. Shanklin, Fullerton, all of CA (US)

(73) Assignee: Hayes Products L.P., Santa Fe Springs, CA (US)

Reexamination Requests:
No. 90/005,176, Dec. 4, 1998
No. 90/005,437, Jul. 28, 1999

Reexamination Certificate for:

| | |
|---|---|
| Patent No.: | **5,039,016** |
| Issued: | **Aug. 13, 1991** |
| Appl. No.: | **07/468,845** |
| Filed: | **Jan. 23, 1990** |

(51) Int. Cl.[7] ..... B05B 7/30

(52) U.S. Cl. ..... 239/314; 239/318; 222/484; 222/554

(58) Field of Search ..... 239/310, 311, 239/314, 318; 222/482, 483, 484, 554

(56) References Cited

U.S. PATENT DOCUMENTS

| | | | |
|---|---|---|---|
| 2,837,374 | 6/1958 | Lipman | 222/484 |
| 3,186,643 | 6/1965 | George et al. | 239/318 |
| 4,750,674 | 6/1988 | Chow et al. | 239/318 |

FOREIGN PATENT DOCUMENTS

| | | |
|---|---|---|
| 240910 | 1/1946 | (CH) . |
| 642872 | 3/1937 | (DE) . |
| 1037231 | 4/1953 | (FR) . |

*Primary Examiner*—Kevin P. Shaver

(57) ABSTRACT

An improved aspiration-type chemical sprayer for dispensing small quantities of a liquid-based chemical into a stream of carrier fluid is disclosed. The sprayer includes a sprayer head assembly sealingly mounted onto a container for storing the chemical to be dispensed. The sprayer head assembly includes a multi-function unitary valve for providing a range of aspiration rates simultaneously with full communication of the container interior to atmospheric pressure. The valve may include means for positive and simultaneous closure of the aspiration and vent passages so as to seal the chemical in the container when the sprayer is not in use.

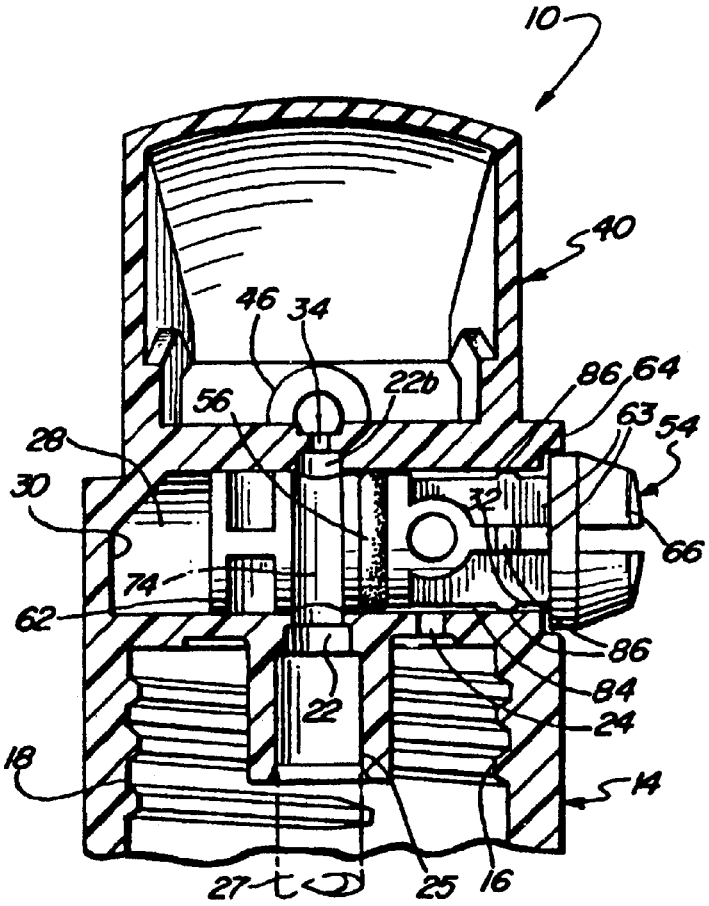

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 6, 8, 11, 14, 15 and 16 are determined to be patentable as amended.

Claims 3–5, 7, 9, 10, 12 and 13, dependent on an amended claim, are determined to be patentable.

New claims 17 and 18 are added and determined to be patentable.

1. An aspiration-type chemical sprayer comprising:

a container having an interior for storing a chemical to be sprayed;

*a pressurized flow of carrier liquid;* a spray head assembly defining an expansion chamber and having inlet means for directing [a] *said* pressurized flow of carrier liquid into said expansion chamber;

connection means for sealably mounting said spray head assembly to said container;

said spray head assembly further defining an aspiration passageway for communication between said container interior and said expansion chamber, and a vent passageway for communication of atmospheric pressure with said container interior;

a valve rotatably positioned within said spray head assembly so as to simultaneously intersect said aspiration passageway and said vent passageway;

said valve having integrally formed thereto aspiration closure means, vent closure means, aspiration channeling means and vent channeling means, for controlling communication through said aspiration and vent passageways; and said valve being formed so as to provide simultaneous registry of said aspiration and vent passageways with said aspiration and vent closure means at one rotational position of said valve and to provide simultaneous registry of said aspiration and vent passageways with said aspiration channeling and vent channeling means at another rotational position of said valve.

2. [The apparatus of claim 1] *An aspiration-type chemical sprayer comprising:*

*a container having an interior for storing a chemical to be sprayed;*

*a spray head assembly defining an expansion chamber and having inlet means for directing a pressurized flow of carrier liquid into said expansion chamber;*

*connection means for sealably mounting said spray head assembly to said container;*

*said spray head assembly further defining an aspiration passageway for communication between said container interior and said expansion chamber, and a vent passageway for communication of atmospheric pressure with said container interior;*

*a valve rotatably positioned within said spray head assembly so as to simultaneously intersect said aspiration passageway and said vent passageway;*

*said valve having integrally formed thereto aspiration closure means, vent closure means, aspiration channeling means and vent channeling means, for controlling communication through said aspiration and vent passageways;*

*said valve being formed so as to provide simultaneous registry of said aspiration and vent passageways with said aspiration and vent closure means at one rotational position of said valve and to provide simultaneous registry of said aspiration and vent passageways with said aspiration channeling and vent channeling means at another rotational position of said valve; and* wherein said aspiration channeling means has, within a designated range of rotational movement of said valve, a range of registry with said aspiration passageway simultaneously with full registry of said vent channeling means with said vent passageway.

6. [The apparatus of claim 5] *An aspiration-type chemical sprayer comprising:*

*a container having an interior for storing a chemical to be sprayed;*

*a spray head assembly defining an expansion chamber and having inlet means for directing a pressurized flow of carrier liquid into said expansion chamber;*

*connection means for sealably mounting said spray head assembly to said container;*

*said spray head assembly further defining an aspiration passageway for communication between said container interior and said expansion chamber, and a vent passageway for communication of atmospheric pressure with said container interior;*

*a valve rotatably positioned within said spray head assembly so as to simultaneously intersect said aspiration passageway and said vent passageway;*

*said valve having integrally formed thereto aspiration closure means, vent closure means, aspiration channeling means and vent channeling means, for controlling communication through said aspiration and vent passageways;*

*said valve being formed so as to provide simultaneous registry of said aspiration and vent passageways with said aspiration and vent closure means at one rotational position of said valve and to provide simultaneous registry of said aspiration and vent passageways with said aspiration channeling and vent channeling means at another rotational position of said valve;*

*wherein said spray head assembly includes an interior surface defining a bore for receiving and engaging said valve;*

*wherein said valve is rotatably positioned within said bore; and* wherein said aspiration and vent closure means each include a respective closed cell defined in said valve for engagement with a respective passageway.

8. [The apparatus of claim 5] *An aspiration-type chemical sprayer comprising:*

*a container having an interior for storing a chemical to be sprayed;*

*a spray head assembly defining an expansion chamber and having inlet means for directing a pressurized flow of carrier liquid into said expansion chamber;*

*connection means for sealably mounting said spray head assembly to said container;*

*said spray head assembly further defining an aspiration passageway for communication between said container interior and said expansion chamber, and a vent passageway for communication of atmospheric pressure with said container interior;*

*a valve rotatably positioned within said spray head assembly so as to simultaneously intersect said aspiration passageway and said vent passageway;*

*said valve having integrally formed thereto aspiration closure means, vent closure means, aspiration channeling means and vent channeling means, for controlling communication through said aspiration and vent passageways;*

*said valve being formed so as to provide simultaneous registry of said aspiration and vent passageways with said aspiration and vent closure means at one rotational position of said valve and to provide simultaneous registry of said aspiration and vent passageways with said aspiration channeling and vent channeling means at another rotational position of said valve;*

*wherein said spray head assembly includes an interior surface defining a bore for receiving and engaging said valve;*

*wherein said valve is rotatably positioned within said bore; and* wherein said aspiration channeling means includes a jaw defining a U-shaped channel.

11. [The apparatus of claim 10] *An aspiration-type chemical sprayer comprising:*

*a container having an interior for storing a chemical to be sprayed;*

*a spray head assembly defining an expansion chamber and having inlet means for directing a pressurized flow of carrier liquid into said expansion chamber;*

*connection means for sealably mounting said spray head assembly to said container;*

*said spray head assembly further defining an aspiration passageway for communication between said container interior and said expansion chamber, and a vent passageway for communication of atmospheric pressure with said container interior;*

*a valve rotatably positioned within said spray head assembly so as to simultaneously intersect said aspiration passageway and said vent passageway;*

*said valve having integrally formed thereto aspiration closure means, vent closure means, aspiration channeling means and vent channeling means, for controlling communication through said aspiration and vent passageways;*

*said valve being formed so as to provide simultaneous registry of said aspiration and vent passageways with said aspiration and vent closure means at one rotational position of said valve and to provide simultaneous registry of said aspiration and vent passageways with said aspiration channeling and vent channeling means at another rotational position of said valve;*

*wherein said spray head assembly includes an interior surface defining a bore for receiving and engaging said valve;*

*wherein said valve is rotatably positioned within said bore;*

*wherein said bore includes an open end and a close end;*

*wherein said valve is received in said bore so as to position said aspiration closure means and said aspiration channeling means proximate said closed end and to position said vent closure means and said vent channeling means proximate said open end; and* wherein said vent channeling means includes a valve head having a plurality of steps on an inner shoulder.

14. [The apparatus of claim 5] *An aspiration-type chemical sprayer comprising:*

*a container having an interior for storing a chemical to be sprayed;*

*a spray head assembly defining an expansion chamber and having inlet means for directing a pressurized flow of carrier liquid into said expansion chamber;*

*connection means for sealably mounting said spray head assembly to said container;*

*said spray head assembly further defining an aspiration passageway for communication between said container interior and said expansion chamber, and a vent passageway for communication of atmospheric pressure with said container interior;*

*a valve rotatably positioned within said spray head assembly so as to simultaneously intersect said aspiration passageway and said vent passageway;*

*said valve having integrally formed thereto aspiration closure means, vent closure means, aspiration channeling means and vent channeling means, for controlling communication through said aspiration and vent passageways;*

*said valve being formed so as to provide simultaneous registry of said aspiration and vent passageways with said aspiration and vent closure means at one rotational position of said valve and to provide simultaneous registry of said aspiration and vent passageways with said aspiration channeling and vent channeling means at another rotational position of said valve;*

*wherein said spray head assembly includes an interior surface defining a bore for receiving and engaging said valve;*

*wherein said valve is rotatably positioned within said bore; and* wherein said valve includes an O-ring positioned to sealingly partition said aspiration closure means and said aspiration channeling means from said vent closure means and said vent channeling means when said valve is installed in said bore.

15. An aspiration-type chemical sprayer comprising:

a container having an interior for storing a chemical to be sprayed;

a spray head assembly defining an expansion chamber and having inlet means for directing a pressurized flow of carrier [fluid] *liquid* into said expansion chamber;

connection means for sealably mounting said spray head assembly to said container;

said spray head assembly further defining an aspiration passageway for communication between said container interior and said expansion chamber, and a vent passageway for communication of atmospheric pressure with said container interior;

a valve movably positioned within said spray head assembly so as to simultaneously intersect said aspiration passageway and said vent passageway;

said valve having integrally formed thereto aspiration closure means, vent closure means, aspiration channeling means and vent channeling means, for controlling communication through said aspiration and vent passageways; and said valve being formed so as to provide simultaneous registry of said aspiration and vent passageways with said aspiration and vent closure means at a designated position of said valve, said aspiration channeling means has, within a designated range of movement of said valve, a range of registry with said aspiration passageway simultaneously with full registry of said vent channeling means with said vent passageway.

16. [The apparatus of claim 15]*An aspiration-type chemical sprayer comprising:*

*a container having an interior for storing a chemical to be sprayed;*

*a spray head assembly defining an expansion chamber and having inlet means for directing a pressurized flow of carrier fluid into said expansion chamber;*

*connection means for sealably mounting said spray head assembly to said container;*

*said spray head assembly further defining an aspiration passageway for communication between said container interior and said expansion chamber, and a vent passageway for communication of atmospheric pressure with said container interior;*

*a valve movably positioned within said spray head assembly so as to simultaneously intersect said aspiration passageway and said vent passageway;*

*said valve having integrally formed thereto aspiration closure means, vent closure means, aspiration channeling means and vent channeling means, for controlling communication through said aspiration and vent passageways;*

*said valve being formed so as to provide simultaneous registry of said aspiration and vent passageways with said aspiration and vent closure means at a designated position of said valve, said aspiration channeling means has, within a designated range of movement of said valve, a range of registry with said aspiration passageway simultaneously with full registry of said vent channeling means with said vent passageway; and* wherein said aspiration and vent closure means each include a respective closed cell defined in said valve for engagement with a respective passageway.

*17. An aspiration-type chemical sprayer comprising:*

*a container having an interior for storing a chemical to be sprayed;*

*a spray head assembly defining an expansion chamber and having inlet means for directing a pressurized flow of carrier liquid into said expansion chamber;*

*connection means for salably mounting said spray head assembly to said container;*

*said spray head assembly further defining an aspiration passageway for communication between said container interior and said expansion chamber, and a vent passageway for communication of atmospheric pressure with said container interior;*

*a valve rotatably positoned within said spray head assembly so as to simultaneously intersect said aspiration passageway and said vent passageway;*

*said valve being integrally formed thereto aspiration closure means, vent closure means, aspiration channeling means and vent channeling means, for controlling communication through said aspiration and vent passageways;*

*said valve being formed so as to provide simultaneous registry of said aspiration and vent passageways with said aspiration and vent closure means at one rotational position of said valve and to provide simultaneous registry of said aspiration and vent passageways with said aspiration channeling and vent channeling means at another rotational position of said valve; and*

*wherein said aspiration closure means comprises a first portion forming sealing engagement with said spray head assembly surrounding said aspiration passageway at said one rotational position and a second portion recessed with respect to said first portion surrounding said aspiration passageway at said one rotational position, and wherein said vent closure means comprises a first section forming sealing engagement with said spray head assembly surrounding said vent passageway at said one rotational position and a second section recessed with respect to said first section surrounding said vent passageway at said one rotational position.*

*18. An aspiration-type chemical sprayer comprising:*

*a container having an interior for storing a chemical to be sprayed;*

*a spray head assembly defining an expansion chamber and having inlet means for directing a pressurized flow of carrier liquid into said expansion chamber;*

*connection means for sealably mounting said spray head assembly to said container;*

*said spray head assembly further defining an aspiration passageway for communication between said container interior and said expansion chamber, and a vent passageway for communication of atmospheric pressure with said container interior;*

*a valve rotatably positioned within said spray head assembly so as to simultaneously intersect said aspiration passageway and said vent passageway;*

*said valve having integrally formed thereto aspiration closure means, vent closure means, aspiration channeling means and vent channeling means, for controlling communication through said aspiration and vent passageways;*

*said valve being formed so as to provide simultaneous registry of said aspiration and vent passageways with said aspiration and vent closure means at one rotational position of said valve and to provide simultaneously registry of said aspiration and vent passageways with said aspiration channeling and vent channeling means at another rotational position of said valve; and*

*wherein said aspiration closure means comprises a first portion forming sealing engagement with said spray head assembly surrounding said aspiration passageway at said one rotational position and a second portion adjacent and recessed with respect to said first portion, and wherein said vent closure means comprises a first section forming sealing engagement with said spray head assembly surrounding said vent passageway at said one rotational position and a second section surface adjacent and recessed with respect to said first section.*

* * * * *